US011752421B2

(12) United States Patent
Eichensehr et al.

(10) Patent No.: US 11,752,421 B2
(45) Date of Patent: Sep. 12, 2023

(54) MODULAR BOARD EXERCISE SYSTEM WITH RESISTANCE BANDS

(71) Applicants: Jodi H. Eichensehr, Burlingame, CA (US); Robert Eichensehr, Burlingame, CA (US)

(72) Inventors: Jodi H. Eichensehr, Burlingame, CA (US); Robert Eichensehr, Burlingame, CA (US)

( * ) Notice: Subject to any disclaimer, the term of this patent is extended or adjusted under 35 U.S.C. 154(b) by 273 days.

(21) Appl. No.: 17/336,312

(22) Filed: Jun. 2, 2021

(65) Prior Publication Data

US 2022/0008809 A1 Jan. 13, 2022

Related U.S. Application Data

(63) Continuation-in-part of application No. 16/702,481, filed on Dec. 3, 2019, now abandoned.

(60) Provisional application No. 62/774,485, filed on Dec. 3, 2018.

(51) Int. Cl.

| | |
|---|---|
| ***A63C 17/00*** | (2006.01) |
| ***A63B 21/055*** | (2006.01) |
| ***A63B 21/00*** | (2006.01) |
| ***A63B 21/04*** | (2006.01) |
| ***A63C 17/01*** | (2006.01) |

(52) U.S. Cl.

CPC ..... *A63C 17/0013* (2013.01); *A63B 21/0442* (2013.01); *A63B 21/0557* (2013.01); *A63B 21/4035* (2015.10); *A63C 17/01* (2013.01)

(58) Field of Classification Search

CPC ... A63C 17/0013; A63C 17/01; A63C 17/012; A63C 17/015; A63C 17/265; A63B 21/0442; A63B 21/0557; A63B 21/4035; A63B 26/003

See application file for complete search history.

(56) References Cited

U.S. PATENT DOCUMENTS 3,684,305 A * 8/1972 McDonald ..... A63C 17/045 280/11.19
4,319,760 A * 3/1982 Romano ..... A63C 17/12 280/11.115
5,087,035 A * 2/1992 Podd, III ..... A63B 69/0022 273/453
5,152,728 A * 10/1992 Podd, III ..... A63B 21/055 119/701
5,795,277 A * 8/1998 Bruntmyer ..... A63C 17/265 482/79
6,981,932 B1 * 1/2006 Huang ..... A63B 21/4035 482/121

(Continued)

*Primary Examiner* — Andrew S Lo

(57) ABSTRACT

In one aspect, a modular board exercise system includes a skateboard. The skateboard includes a deck. The deck includes a plurality of hookable portions, and a pair of skateboard trucks coupled with a bottom side of the deck. The skateboard truck includes a pair of skateboard wheels. The system includes a plurality of resistance bands includes an elastic resistance band, a handle coupled with the distal end of the elastic resistance band, and a connecter clip coupled with the proximate end of the elastic resistance band. The connecter clip is attachable to one of the hookable portions. The system includes a stopper base. The stopper base includes a flat pad having a pair of grooves configured to hold each pair of skateboard wheels in a fixed position.

16 Claims, 7 Drawing Sheets

(56) References Cited

U.S. PATENT DOCUMENTS

| | | | | |
|---|---|---|---|---|
| 7,601,107 | B2 * | 10/2009 | Maloy | A63B 23/1245 482/79 |
| 2002/0151416 | A1 * | 10/2002 | List | A63B 21/154 482/121 |
| 2010/0276912 | A1 * | 11/2010 | Lange | A63C 17/26 280/727 |
| 2011/0291375 | A1 * | 12/2011 | Lawson | A63C 17/265 434/247 |
| 2013/0123077 | A1 * | 5/2013 | Dunegan | A63B 21/0442 482/139 |
| 2015/0018178 | A1 * | 1/2015 | Carbone | G09B 19/0038 482/146 |
| 2015/0190679 | A1 * | 7/2015 | Carbone | A63B 21/00069 482/146 |
| 2016/0193504 | A1 * | 7/2016 | Ambrozak | A63B 26/003 482/146 |
| 2020/0298052 | A1 * | 9/2020 | Dalmia | A63B 22/0694 |
| 2021/0121738 | A1 * | 4/2021 | Famiglietti | A63B 22/16 |

* cited by examiner

MODULAR BOARD EXERCISE SYSTEM WITH RESISTANCE BANDS

CROSS-REFERENCE TO RELATED APPLICATIONS

This application is a claims priority to U.S. patent application Ser. No. 16/702,481, titled MODULAR BOARD EXERCISE SYSTEM WITH RESISTANCE BANDS and filed on 3 Dec. 2019. This provisional application is hereby incorporated by reference in its entirety.

This U.S. patent application Ser. No. 16/702,481 claims the benefit of 62/774,485 is a claims priority, to U.S. provisional patent application No. 62774485, titled MODULAR BOARD EXERCISE SYSTEM WITH RESISTANCE BANDS and filed on 3 Dec. 2018. This application is hereby incorporated by reference in its entirety.

BACKGROUND

Skateboarding is known to develop key muscles stability muscle groups. When standing and balancing on a skateboard, a users core muscles must work with lower back muscles to keep the spine aligned so that the user can stand up straight. Additionally, skateboards move in response to the user's motion even the skateboard is not rolling forward. For example, a non-rolling skateboard still has a low level of motion along the roll, yaw and pivot dimensions of motion in response to the user's movement. In this way, standing on a skateboard while performing other exercises can be used to exercise stability-providing muscles and improve balance.

At the same time, a non-rolling skateboard can be more stable to stand on than other exercise equipment designed to solely to improve balance. Consequently, users can perform more strenuous exercises and motions with minimum chance of falling. These types of compound exercises are increasingly popular for sport training and general fitness. Accordingly, there is a need to improve exercise equipment and devices to improve both strength and balance.

SUMMARY OF THE INVENTION

In one aspect, a modular board exercise system includes a skateboard. The skateboard includes a deck. The deck includes a plurality of hookable portions, and a pair of skateboard trucks coupled with a bottom side of the deck. The skateboard truck includes a pair of skateboard wheels. The system includes a plurality of resistance bands includes an elastic resistance band, a handle coupled with the distal end of the elastic resistance band, and a connecter clip coupled with the proximate end of the elastic resistance band. The connecter clip is attachable to one of the hookable portions. The system includes a stopper base. The stopper base includes a flat pad including a flat pad with a pair of grooves configured to hold each pair of skateboard wheels in a fixed position.

BRIEF DESCRIPTION OF THE DRAWINGS

The present application can be best understood by reference to the following description taken in conjunction with the accompanying figures, in which like parts may be referred to by like numerals.

The Figures described above are a representative set and are not an exhaustive with respect to embodying the invention.

DESCRIPTION

Disclosed are a system, method, and article of manufacture of modular board exercise system with resistance bands. Although the present embodiments have been described with reference to specific example embodiments, it will be evident that various modifications and changes may be made to these embodiments without departing from the broader spirit and scope of the particular example embodiment.

References throughout this specification to "one embodiment," "an embodiment," or similar language mean that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Exemplary Definitions

Resistance band is an elastic band used for strength training.

Skateboard is a type of sports equipment. An example skateboard can comprise a designed wood-board deck (e.g. Maplewood, etc.) combined with a coating (e.g. a polyurethane coating, etc.) used for making smoother slides and stronger durability. The wood-board deck can be a rigid/hard plastic, carbon fibre, metal, Maplewood/Bamboo amalgam/combination, other woods, etc. In one example, the skateboard can be 32.00 inches in length and 12.00 inches in width. These dimensions are provided by way of example and not of limitation as other example embodiments can have different lengths and/or widths.

An example skateboards can be made with a specified number of plies (e.g. seven plies) of wood. Wheels can be attached to the underside of the deck by a pair of skateboard trucks. It is noted that the deck can be made of other materials than wood as well.

Wheelbase is the distance between the centers of the front and rear wheels.

Exemplary Systems

Figure 1:
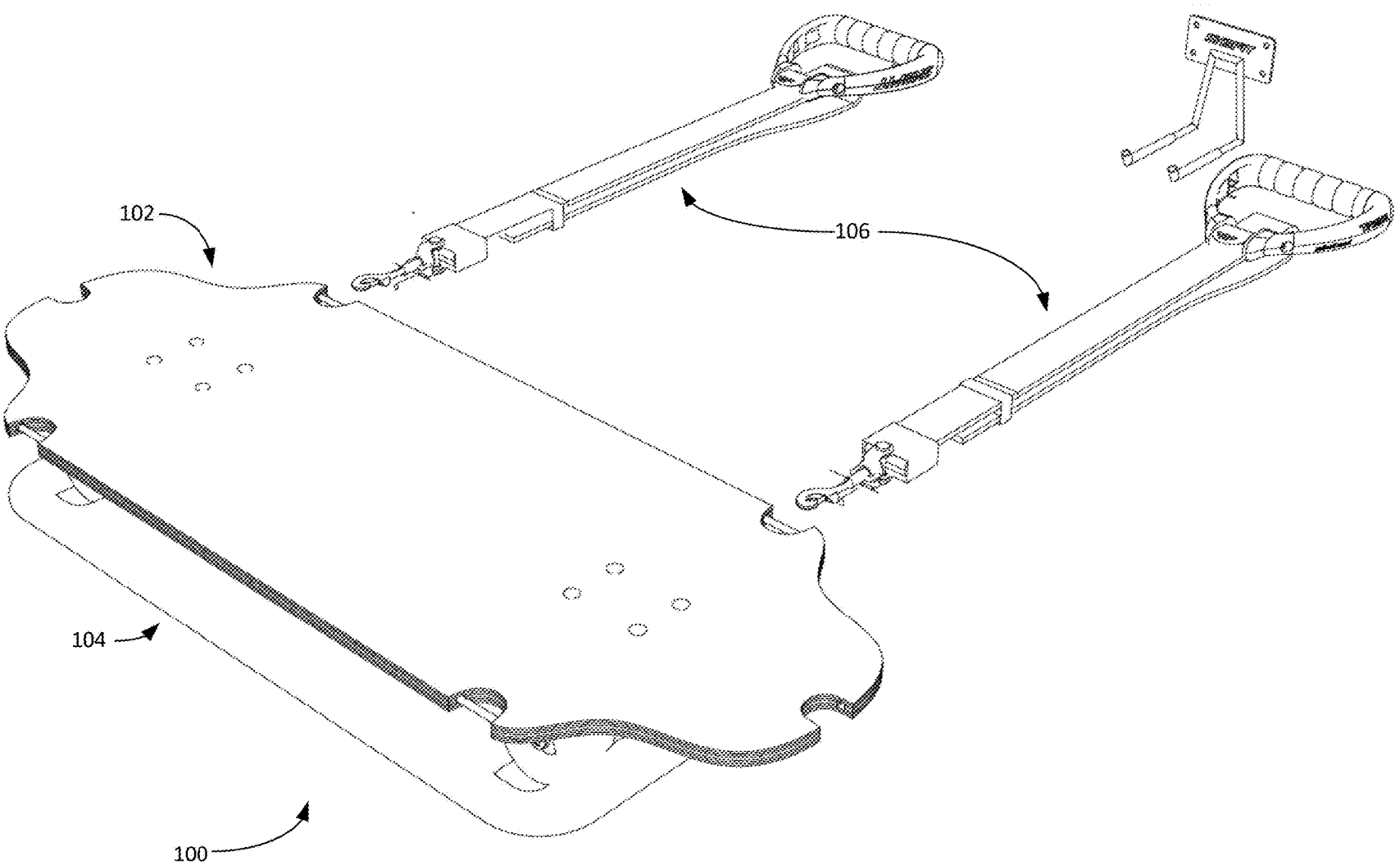
FIG. 1 depicts an example modular board exercise system with resistance bands, according to some embodiments.

FIG. 1 depicts an example modular board exercise system 100 with resistance bands, according to some embodiments. Modular board exercise system 100 can include the following components, inter alia: skateboard 102; stopper base 104; small pad; set of elastic resistance bands 106 (e.g. with lighter or heavier options); etc. Modular board exercise system 100 can provide a complete piece of fitness equipment that is ideal for class, gym, or home workouts. Modular board exercise system 100 can pack up into a lightweight traveling bag. Modular board exercise system 100 can provide various levels of balance and stability exercise with the truck and wheel system. Modular board exercise system 100 can use adjustable bands that enable easy elastic strength adjustment. Modular board exercise system 100 can be used for various exercises (e.g. a variety of functional strength exercises etc.).

Optionally, modular board exercise system 100 can include various computing systems, computer network systems, sensors (e.g. position sensors, weight sensors, velocity/acceleration sensors, etc.). These systems can be used to obtain and/or track a user's historical performance and/or current performance with specified exercises. For example, a user's historical training data can be tracked and provided to the user via mobile device application and/or website interface. In another example, this data can be used to monitor a user's form during an exercise and provide corrective and/or positive feedback (e.g. via a computer interface, haptic feedback, sound feedback, etc.

More specifically, modular board exercise system 100 can include a skateboard element 102. Skateboard element 102 can be a wooden board with wheels (e.g. four wheels), resistance band attachments, attachable padding, friction strips, etc. Additional information regarding skateboard 102 is provide infra in the description of FIGS. 2-5.

The length of the resistance bands 106 can be adjustable. Resistance bands 106 can hook onto skateboard 102 (e.g. bottom of elastic band to a hookable portions 508-518 of skateboard 102, etc.). Resistance bands can include a flexible handle (e.g. see FIGS. 6 and 7 infra). The flexible handle can be formatted such that the user's wrist does not rub against it during an exercise action.

Stopper base 104 can be a board that restrains the motion of skateboard 102. The wheels of skateboard 102 can be set into the transverse grooves/holes shown in stopper base 104. In this way, the motion of skateboard 102 can be stabilized and/or otherwise limit in range.

Modular board exercise system 100 can include a small pad. The pad is attached under the system to grab whenever you need to use your knees or sit, making it comfortable to do various kneeling-based exercise.

It is noted that the shape and other dimensions of skateboard 102 can be varied based on the exercises to be performed. For example, the skateboard deck can be in substantially circular shape, ellipsoid shape, crescent shape, etc.

Figure 2:
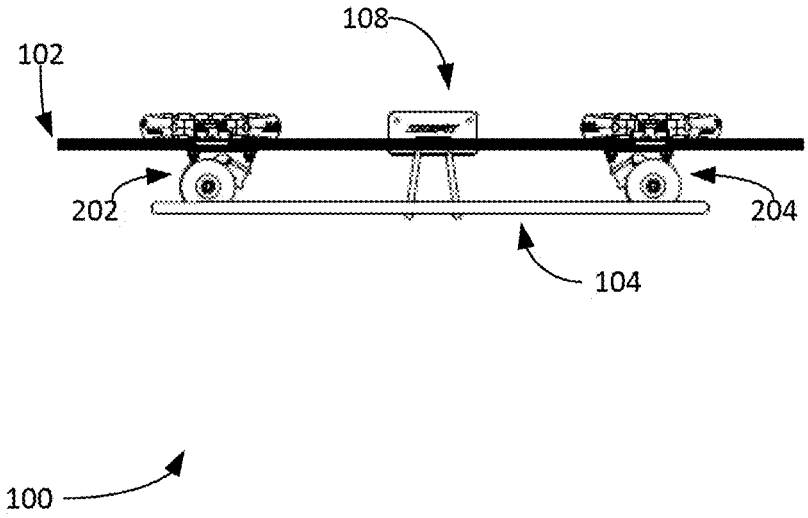
FIG. 2 depicts example side view of a skateboard for use with a modular board exercise system, according to some embodiments.

FIG. 2 illustrates an example side view of a modular board exercise system 100 with resistance bands, according to some embodiments. As shown, modular board exercise system 100 can be stored by hanging on a wall hanger 108. Modular board exercise system 100 includes trucks 204 and 206. A pair of wheels (e.g. skateboard wheels) can be attached to each truck. Trucks 204 and 206 (e.g. with urethane bushings) can include wheels (e.g. with sealed bearings), bushings, nuts and bolts to fasten the truck and wheel assembly to the bottom of the deck. Skateboard decks can also include various plastic parts such as: side, tail, nose guards, etc.

Figure 3:
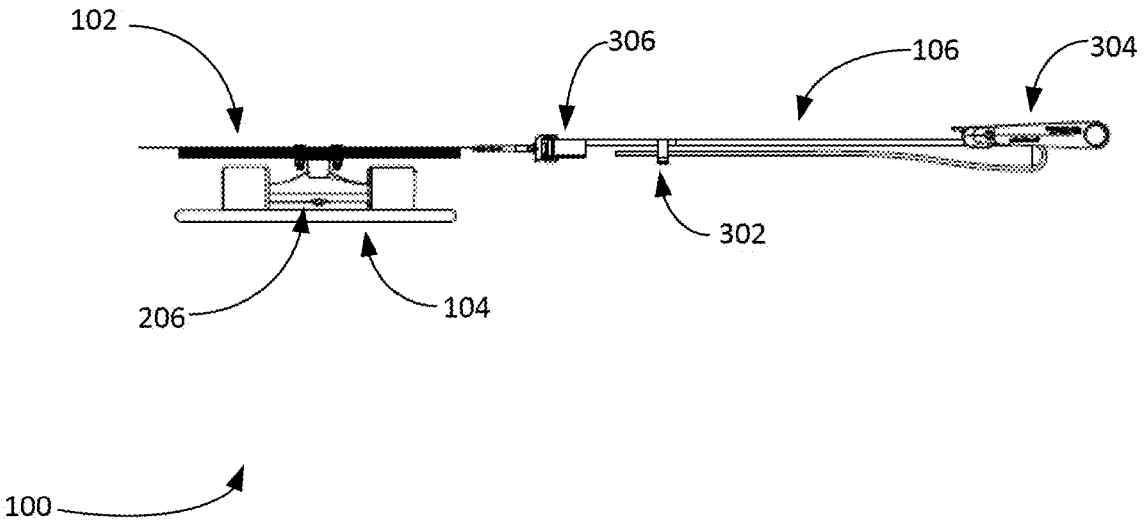
FIG. 3 illustrates an example front view of a modular board exercise system with resistance bands, according to some embodiments.

FIG. 3 illustrates an example front view of a modular board exercise system 100 with resistance bands, according to some embodiments. As shown, a proximate-end of the elastic resistance bands 106 can be connected to hookable portions located on the side of skateboard 102 (e.g. hookable portions 512 and 514 discussed infra) using a connector clip 306. An excess latex holder 302 can be used to hold excesses latex band in place against the use portion of the band. The distal end of elastic resistance bands 106 can be attached to a handle (e.g. using a cam buckle).

Figure 4:
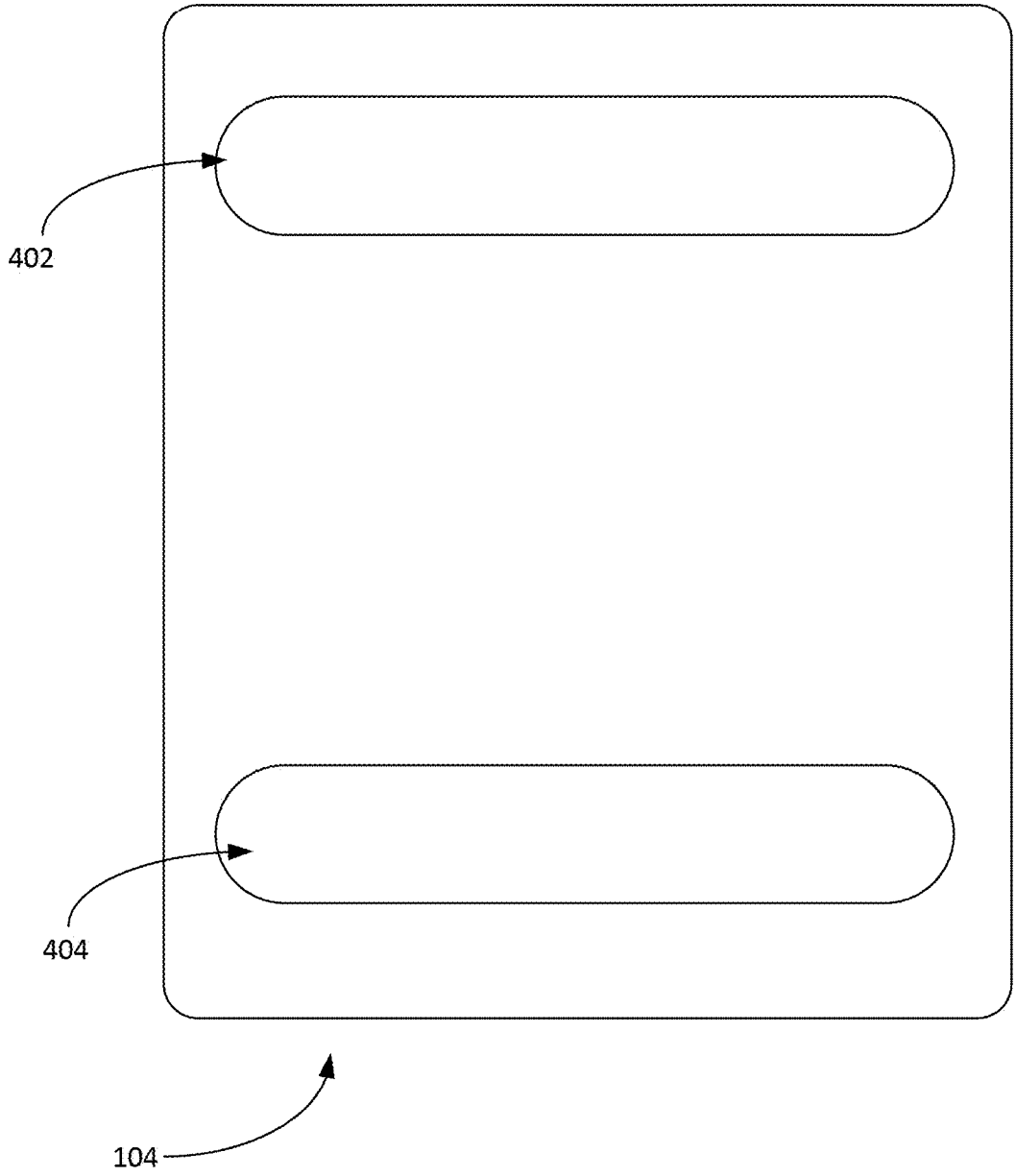
FIG. 4 shows an example stopper board/pad, according to some embodiments.

FIG. 4 shows an example stopper pad 104, according to some embodiments. As shown, stopper pad 104 can have various configurations, such as, inter alia: non-foldable and rigid, foldable and rigid, rollable, etc. As shown, the placement of the wheels of skateboard 102 into stopper grooves 402 and 404. Stopper grooves 402 and 404 can be various shapes, such as: a stadium shaped, rectangular shaped, etc. A stadium shaped can be a geometric figure consisting of a rectangle with top and bottom lengths a whose ends are capped off with semicircles of radius r. Grooves 402 and 404 can be indentations or empty spaces.

Stopper pad 104 can be placed underneath the skateboard 102 to stop skateboard from rolling. Stopper pad 104 can be made from various materials. Stopper grooves 402 and 404 can be of various dimensions depending on the desired amount of movement and stability of the skateboard 102. Grooves 402 and 404 can be of a size such that their interior border placed closely against the skateboard wheels to prevent movement of the skateboard during an exercises while a user is standing on the skateboard.

In various examples, stopper pad 104 can be foam and placed underneath skateboard with cutout for skateboard wheels to rest in. Stopper pad 104 can be EVA expanded foam or other durable lightweight matting. Stopper pad 104 can provide balance from movement of skateboard's adjustable trucks (e.g. trucks 204 and 206 discussed infra, etc.). This can be option in use as exercises can be used in a lunge or other exercises. In one example, skateboard 102 can be turned upside down and the flat side placed on the floor or foam stopper. A separate foam stopper can be used as a knee saver in some exercises as well (e.g. in lieu of stopper pad 104). In other examples, stopper pad 104 can be made of rubber, hessian and cork, etc. The bottom of stopper pad 104 can be coated in rubber or other adhesive material to enhance grip with the ground.

Figure 5:
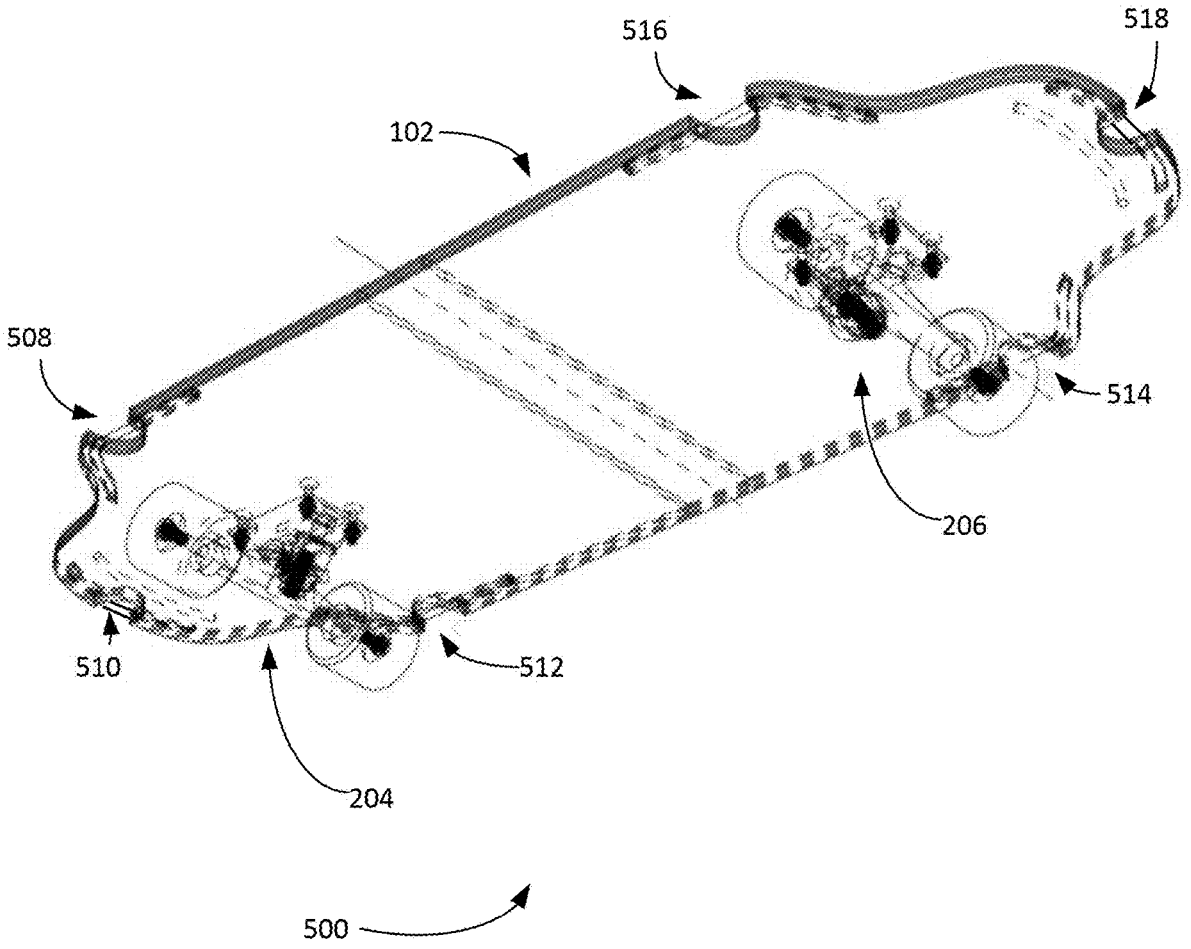
FIG. 5 depicts example underside view of a skateboard for use with a modular board exercise system, according to some embodiments.

FIG. 5 depicts example underside view of a skateboard 102 for use with a modular board exercise system, according to some embodiments. As noted supra, skateboard 102 can comprise a wood board combined with a coating used for making smoother slides and stronger durability. In some examples, skateboard 102 can be made with a specified number of plies (e.g. seven plies) of wood. Skateboard shape can depend upon its desired function and include attachments for exercise bands and/or other exercise related devices. Skateboard 102 can have a wheelbase with wheels attached. The wheels can be hard or soft wheels.

The skateboard decks can vary in size. In some examples, the deck can be 7 to 10.5 inches (18 to 27 cm) wide. Wider decks can be used for greater stability when exercising. In another example, the skateboard deck can be between 28 and 33 inches (71 and 84 cm) long. These dimensions are provided by way of example. The underside 202 of the deck can be printed with a design by the manufacturer, blank, exercise/use/assembly instructions, etc.

The top side of the deck (not shown) can include a smooth surface, friction surface (e.g. grip tape, etc.), padding, and/or any combination thereof. In one example, the grip tape can be a sheet of paper or fabric with adhesive on one side and a surface similar to fine sandpaper on the other. Grip tape can be applied to the top surface of a board to allow the rider's feet to grip the surface and help the skater stay on the board while doing exercises.

Attached to the deck are two metal (e.g. made of aluminum alloy) trucks 204 and 206, which connect the wheels and bearings to the deck. Trucks 204 and 206 can be further composed of two parts. A top part of the truck can be screwed and/or laminated to the deck. This top portion can include a baseplate and beneath it is a hanger portion of the truck. The axle can run through the hanger. Between the baseplate and the hanger are bushings, rubbers and/or grommets. These can provide the cushion mechanism for turning the skateboard. The bushings cushion the truck when it turns. It is noted that the stiffer the bushings, the more resistant the skateboard can be to turning a well. The softer the bushings, the easier it is to maneuver (e.g. turn) the skateboard. Bushings can be in varying shapes and urethane formulas as well as durometers, which may affect turning, rebound and durability. A bolt called a kingpin holds these parts together and fits inside the bushings. By tightening and/or loosening the kingpin nut, the trucks can be adjusted loosely for better turning and tighter for more stability. The position of the hanger with respect to the baseplate can be set by the pivot. The pivot can be a rod that slots into the corresponding seat in the baseplate. The pivot can stop the hanger from rotating around the kingpin. The pivot can enable some movement around the bushings. The space between the pivot and its seat in the baseplate can be filled by a pivot cup. The pivot cup can be composed of plastic. An axle width can be based on the width of the deck. The wheels of a skateboard can be made of polyurethane. Wheels can vary in hardness as well.

In one example, trucks 204 and 206 can be attached to skateboard 102 by configuring the metal attachment portions of trucks 204 and 206 as embedded into the middle of the board. The metal can be a spring metal. A pair of wheels can be coupled with each truck.

Each skateboard wheel is mounted on its axle via two bearings. Example bearings can be in the industrial standard "608" size, with a bore of 8 mm (or 10 mm depending on the axle), an outer diameter of 22 mm, and a width of 7 mm. These can be made of steel, silicon nitride, other ceramic, etc.

Mounting hardware can be provided. In one example, mounting hardware can include a set of eight 10-32 UNF bolts (e.g. an Allen or Phillips head), and locknuts (e.g. matching nylon lockouts). They can be used to attach the trucks (and any type of risers, etc.) to skateboard 102. In this way, the trucks can be attached with or without risers.

As noted supra, skateboard 102 can include hookable portions 508-518. As shown, hookable portions 508-518 can be located at specified locations along the periphery of skateboard 102. In other examples, not shown, hookable portions 508-518 can be located on the deck top surface and/or bottom surface as well.

Figure 6:
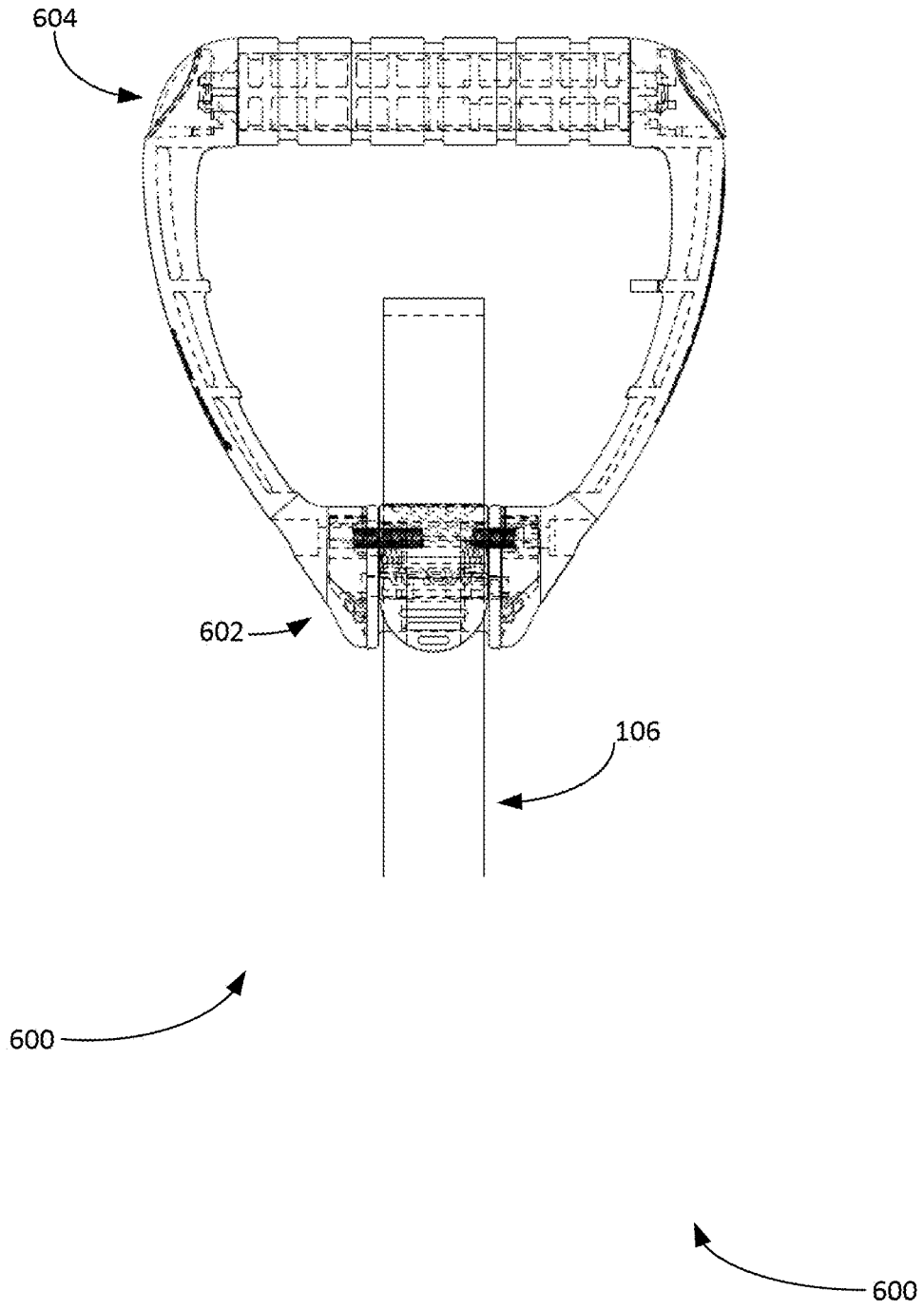
FIGS. 6-7 illustrate example views of a handle for elastic resistance bands, according to some embodiments.
Figure 7:
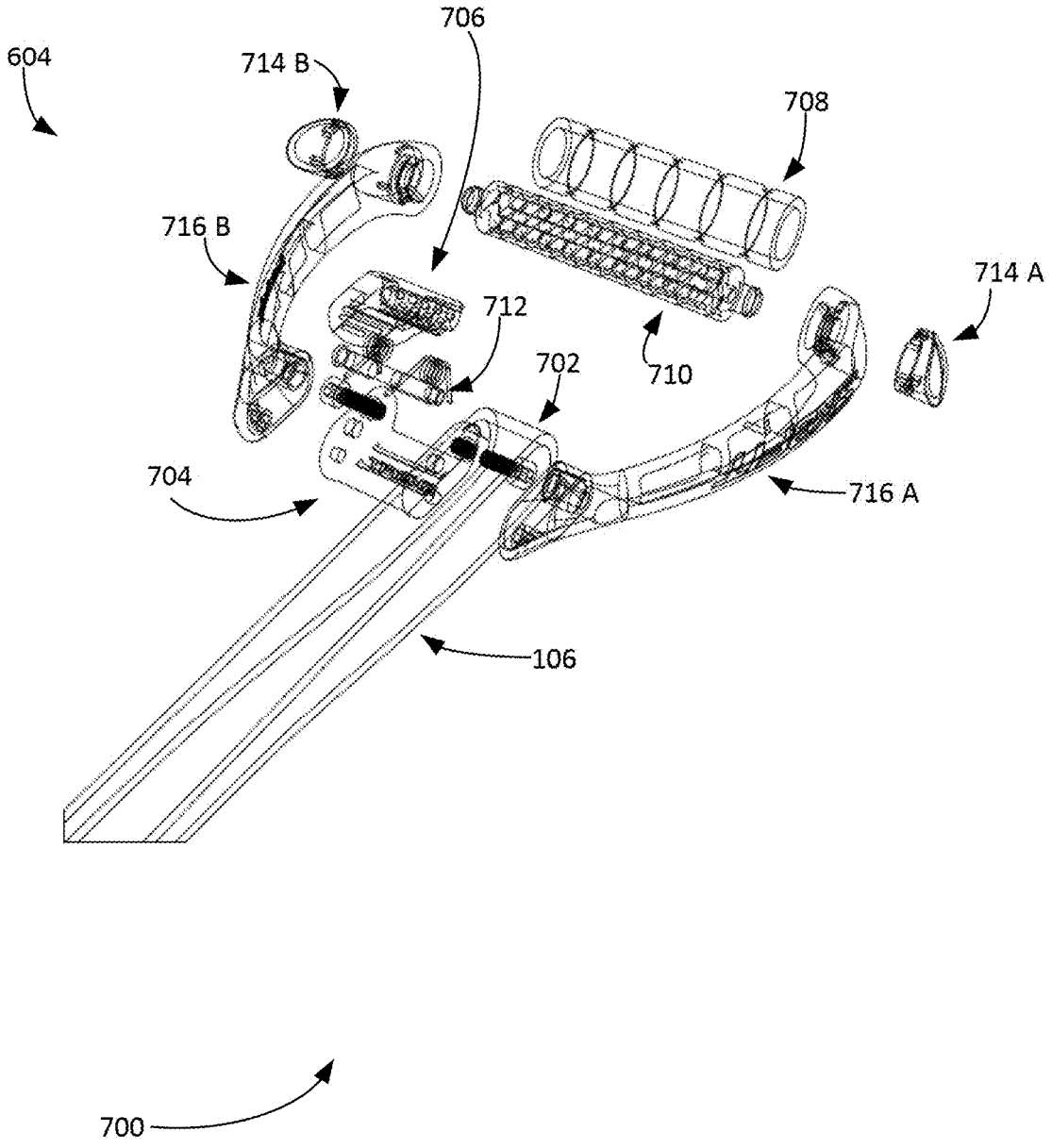

FIGS. 6-7 illustrate example views of a handle 604 for elastic resistance bands 106, according to some embodiments. Handle 604 can include an attachment portion 602 for attaching various elastic resistance bands 106. Handle 604 can include an upper rounded edge. Handle 604 can include a transverse rotating portion to reduce the inner radius and maintain a specified grip area size. In one example, handle 604 can include a handle with soft sides leading to cam buckle 602. Handle 604 can include various adjustment mechanisms such as, for example, a cam buckle 602. Portions of handle 604 can include foam and/or other soft materials. Elastic resistance bands 106 can be, inter alia, a latex round band, latex flat band, flat bungee and latex at end, etc. Elastic resistance bands 106 can terminate on one end with a lock (e.g. a dog-leash style spring-loaded lock, a hook mechanism, other mounting mechanisms, etc.). Cam buckle 602 functions as an attachment system for attaching handle 604 to elastic resistance band 106.

It is noted that the spring-loaded cam buckle 602 is designed to allow the latex/resistance band 106 to slide up and down altering the length of the latex/resistance band 106 for various exercises while the cam is pressed in the open position. The cam buckle 602 also holds the latex/resistance band 106 firmly when in the closed position from slippage while under pressure or tension.

FIG. 7 illustrates an example exploded view of handle 604 and cam buckle 602, according to some embodiments. Handle 604 includes plastic hand grip 710 and foam hand grip 708. These are coupled with handles 716 A-B. End caps 714 A-B can be used to hold/lock handles 716 A-B to plastic hand grip 710 and foam hand grip 708.

As shown, cam buckle 602 can include a cam buckle lever and inside grip surface 706. Cam buckle 602 can use post and spring mechanism 702 to create a tension to hold elastic band 106 against cam buckle lever and inside grip surface 706 and cam buckle frame 704. In some examples, cam buckle 602 can be located elsewhere. For example, a cam buckle 602 can be located with/couple with connector clip 306.

The elastic resistance band 106 can be fed through a cam buckle attached to a handle 604. When a user presses down on 706, the cam buckle 602 raises up. The user can slide and adjust length of latex band. In this way, band length can be adjusted by the user. Handle 604 and cam buckle 602 can be made of metal and rest is made of the handle elements can be made of a hard durable plastic. As shown, the handle 604 has a rotatable portion 710 with a foam grip 708.

Users can perform a wide variety of exercises with the modular board exercise system (e.g. can stand on board and clip latex band to front side and do curls, shoulder presses, etc.). Users can also use different widths of latex bands (e.g. half inch to an inch and three quarters, etc.) to include resistance. In some examples, different handle sizes can be used as well. Moreover, skateboard 102 can be stored on a wall mount and/or door mount. Moreover, elastic resistance bands 106 can use a wall mount and/or door mount to enable exercises from various angles.

CONCLUSION

Although the present embodiments have been described with reference to specific example embodiments, various modifications and changes can be made to these embodiments without departing from the broader spirit and scope of the various embodiments.

What is claimed is:

1. A modular board exercise system comprising:

a skateboard comprising:

a deck comprising a plurality of hookable portions, a pair of skateboard trucks coupled with a bottom side of the deck, wherein the skateboard truck comprises a pair of skateboard wheels;

a plurality of resistance bands each comprising:

an elastic resistance band, a handle coupled with a distal end of the elastic resistance band, and a connecter clip coupled with a proximate end of the elastic resistance band, wherein the connecter clip is attachable to one of the hookable portions; and a stopper base comprising a flat pad having a pair of grooves configured to hold each pair of skateboard wheels in a fixed position.

2. The modular board exercise system of claim 1, wherein the connector clip comprises a spring-loaded dog clip.

3. The modular board exercise system of claim 2, wherein a hookable portion comprises an inset metal attachment that is laminated inside the deck of the skateboard.

4. The modular board exercise system of claim 3, wherein a skateboard truck is attached to the deck with a metal attachment portion of the skateboard truck embedded into a middle of the deck.

5. The modular board exercise system of claim 4, wherein the deck comprises a Maplewood board deck with a wood-board deck in a polyurethane coating.

6. The modular board exercise system of claim 5, wherein the pair of grooves are a stadium shape with dimensions such that an interior border of the grooves fits against the skateboard wheels to prevent movement of the skateboard during an exercise while a user is standing on the skate-board.

7. The modular board exercise system of claim 6, wherein the elastic resistance band comprises a flat latex band.

8. The modular board exercise system of claim 7, wherein the handle comprises a flexible handle.

9. The modular board exercise system of claim 8, wherein the flexible handle comprises a plastic hand grip covered by a foam hand grip for traverse rotation during an exercise.

10. The modular board exercise system of claim 9, wherein the flexible handle comprises a cam buckle functioning as an attachment system for attaching the handle to the flat latex band.

11. The modular board exercise system of claim 10, wherein the cam buckle comprises a cam buckle lever and an inside grip surface.

12. The modular board exercise system of claim 11, wherein the cam buckle uses a post and spring mechanism that provides a tension that holds the flat latex band against the cam buckle lever and the inside grip surface.

13. The modular board exercise system of claim 12, wherein the stopper base comprises an EVA expanded foam.

14. The modular board exercise system of claim 13, wherein the pair of skateboard trucks are coupled with a bottom side of the deck using a lamination-based coupling.

15. The modular board exercise system of claim 1, wherein the skateboard is 32.00 inches in length and 12.00 inches in width.

16. The modular board exercise system of claim 1, wherein the skateboard comprises a Maplewood/Bamboo amalgam.

* * * * *